US005534980A

United States Patent [19]

Tanaka

[11] Patent Number: 5,534,980

[45] Date of Patent: Jul. 9, 1996

[54] ELECTROPHOTOGRAPHIC IMAGE FORMING APPARATUS HAVING A CHARGE REMOVING MEANS

[75] Inventor: Nariaki Tanaka, Osaka, Japan

[73] Assignee: Mita Industrial Co., Ltd., Osaka, Japan

[21] Appl. No.: 418,658

[22] Filed: Apr. 10, 1995

[30] Foreign Application Priority Data

May 31, 1994 [JP] Japan ..... 6-119322

[51] Int. Cl.[6] ..... G03G 5/06; G03G 21/00

[52] U.S. Cl. ..... 355/219; 355/211

[58] Field of Search ..... 355/218, 219, 355/210, 211

[56] References Cited

U.S. PATENT DOCUMENTS 4,974,964 12/1990 Yoshihara et al. ..... 366/152
5,272,504 12/1993 Omura et al. ..... 355/218

FOREIGN PATENT DOCUMENTS 56-24383 3/1981 Japan .
59-226372 12/1984 Japan ..... 355/219
62-30286 2/1987 Japan ..... 355/219
62-85281 4/1987 Japan .
3188459 8/1991 Japan .
3257467 11/1991 Japan .

*Primary Examiner*—Joan H. Pendegrass
*Assistant Examiner*—Sophia S. Chen
*Attorney, Agent, or Firm*—Renner, Otto, Boisselle & Sklar

[57] ABSTRACT

An image forming apparatus includes a rotatable photosensitive member including a conductive base and an organic photosensitive film located on a surface of the base and containing two charge generation materials which have different light absorbing characteristics from each other and different wavelengths showing a maximum light absorbance from each other; a charging device for charging the organic photosensitive film, the charging device being located in the vicinity of the photosensitive member; a charge removing member including a light source for radiating light toward the organic photosensitive film to uniformize the potential of a surface of the organic photosensitive film, the light having a wavelength in the range between wavelengths corresponding to half of a maximum light absorption of at least one of the two charge generation materials; an exposing device for radiating light corresponding to an image toward the organic photosensitive film charged by the charging device; and a developing device located downstream with respect to the exposing device in a rotation direction of the photosensitive member. The residual carriers in the organic photosensitive film are reduced, and thus the image quality is significantly improved.

12 Claims, 4 Drawing Sheets

ELECTROPHOTOGRAPHIC IMAGE FORMING APPARATUS HAVING A CHARGE REMOVING MEANS

BACKGROUND OF THE INVENTION

1. Field of the Invention

The present invention relates to an image forming apparatus using an electrophotographic technology, and in particular to an image forming apparatus which is provided with a light generation device such as a charge removing member for radiating light having a specific wavelength to an organic photosensitive film located on a surface of a photosensitive drum and forms an image by charging and exposing the photosensitive drum to light.

2. Description of the Related Art

Conventionally, image forming apparatuses using electrophotographic technologies have been actively developed for use as, for example, electrostatic copiers or printers.

Briefly referring to FIG. 3, a conventional image forming apparatus 1 using an electrophotographic technology will be described. An image forming apparatus 1 includes a rotatable photosensitive drum 3 having a photosensitive film 2 located on a surface thereof, a main charger 4 for uniformly supplying the photosensitive film 2 with a prescribed level of electric charge, an optical device 5 for exposing the photosensitive film 2 to light and forming an electrostatic latent image on the photosensitive film 2, a developing device 6 for developing the electrostatic latent image formed on the photosensitive film 2 into a toner image, a transfer device 8 for transferring the toner image on the photosensitive film 2 onto a recording paper sheet 7, a cleaning device 9 provided with a cleaning blade for removing the residual toner on the photosensitive film 2, and a charge removing device 10 for removing the residual charge on the photosensitive film 2 and thus setting the surface potential of the photosensitive film 2 at a prescribed uniform level.

In the image forming apparatus 1 having the above-described structure, an image is formed in the following manner.

First, the main charger 4 uniformly supplies the photosensitive film 2 with a prescribed level of electric charge. Next, light is radiated to the photosensitive film 2 by the optical device 5, thereby forming an electrostatic latent image on the photosensitive film 2. Toner is supplied to the photosensitive film 2 by the developing device 6, thereby developing the electrostatic latent image into a toner image. The toner image on the photosensitive film 2 is transferred to the recording paper sheet 7 by the transfer device 8. After the transference, the residual toner on the photosensitive film 2 is removed by the cleaning device 9. Light is radiated on the photosensitive film 2 by the charge removing device 10, thereby removing the residual charge on the photosensitive film 2. Thus, the surface potential of the photosensitive film 2 is uniformly set at a prescribed level. Thereafter, the photosensitive film 2 is charged again by the main charger 4. Such a process is repeated in accordance with the rotation of the photosensitive drum 3.

The photosensitive film 2 is formed of an inorganic or an organic material. Usable inorganic materials include, for example, Se-type materials and amorphous Si-type materials.

Recently, more and more photosensitive films are formed of an organic material due to higher safety and easier processibility thereof. Organic photosensitive bodies formed of an organic photosensitive material are classified into multiple-layer organic photosensitive bodies and single-layer organic photosensitive bodies.

A multiple-layer photosensitive body includes a charge generation layer and a charge carrying layer. The charge carrying layer contains a charge carrying material. The charge carrying material may be a hole carrying material or an electron carrying material. There are various hole carrying materials which have a satisfactory carrying ability, whereas no electron carrying material having a satisfactory carrying ability has been developed. Accordingly, multiple-layer organic photosensitive bodies are mostly of a type to be negatively charged. However, when such a type of photosensitive body is charged using a charger for performing corona discharge, a large amount of ozone is generated. In order to protect the human body and the environment, an additional measure to deal with ozone is needed.

In an attempt to solve the above-described problem, single-layer organic photosensitive bodies have been developed. A single-layer organic photosensitive body includes a charge carrying medium containing a charge generation material diffused therein. By using a charge carrying material having a satisfactory hole carrying ability as the charge carrying medium, a single-layer photosensitive body of a type to be positively charged can be easily formed.

Compared to a multiple-layer organic photosensitive body, a single-layer organic photosensitive body is easier to produce and thus is preferable. However, a single-layer photosensitive film formed of a single-layer organic photosensitive body retains a generally high level of charge even after charge removal. If the photosensitive film is positively charged in the state of having residual electrons therein, such residual electrons move to a surface of the photosensitive film due to the surface potential obtained by charging and thus reduces the surface potential.

FIG. 4 is a graph illustrating the surface potential and the residual potential with respect to repeated rotation of a photosensitive drum formed of a conventional organic photosensitive material. In the case that an image is formed by the repeated rotation of the photosensitive drum, the level of surface potential reduces significantly and the level of residual potential increases significantly, causing non-uniformity in the image density. Further, residual photocarriers in the organic photosensitive film which causes such a high level of residual potential undesirably reduces the surface potential obtained by charging. Moreover, the organic photosensitive film can be initially charged sufficiently but wears out while being used repeatedly. Accordingly, the trap site is increased and thus the organic photosensitive film becomes more difficult to be charged.

SUMMARY OF THE INVENTION

An image forming apparatus according to the present invention includes a rotatable photosensitive member including a conductive base and an organic photosensitive film located on a surface of the base and containing two charge generation materials which have different light absorbing characteristics from each other and different wavelengths showing a maximum light absorbance from each other; a charging device for charging the organic photosensitive film, the charging device being located in the vicinity of the photosensitive member; an exposing device for radiating light toward the organic photosensitive film charged by the charging device; a developing device located downstream with respect to the exposing device in a rotation direction of the photosensitive member; and a charge removing member including a light source for radiating light toward the organic photosensitive film to uniformize the potential of a surface of the organic photosensitive film, the light having a wavelength in the range between wavelengths corresponding to half of a maximum light absorption of at least one of the two charge generation materials.

In one embodiment of the invention, the image forming apparatus further includes a transfer device and a cleaning device. The transfer device is located downstream with respect to the exposing device in the rotation direction of the photosensitive member. The cleaning device is located downstream with respect to the transfer device in the rotation direction of the photosensitive member. The charge removing member is located in at least one position selected from the group consisting of between the cleaning device and the charging device, between the charging device and the developing device, between the developing device and the transfer device, and between the transfer device and the cleaning device.

In one embodiment of the invention, the charge removing member is located upstream with respect to the charging device in the rotation direction of the photosensitive member.

In one embodiment of the invention, the charge removing member includes a single light source which generates light having a wavelength in the range which is common to the range between wavelengths corresponding to half of the maximum light absorbance of one of the two charge generation materials and the range between wavelengths corresponding to half of the maximum light absorbance of the other charge generation material.

In one embodiment of the invention, the charge removing member includes two light sources each generating light of a single color having a wavelength in the range between wavelengths corresponding to half of the maximum absorption of the respective charge generation material.

In one embodiment of the invention, the photosensitive member has such a size that repeated rotation thereof allows transfer of an image on the organic photosensitive film onto a single recording medium, and the charge removing member radiates light having such an intensity that a residual potential on a surface of the photosensitive member left by charge removal after the first rotation of the photosensitive member is no greater than about 10% of the surface potential thereof obtained by charging and that an increase ratio of the residual potential after the final rotation of the photosensitive member is no greater than about 30%.

In one embodiment of the invention, the charge removing member generates light having an intensity which is at least about 20 times the intensity for required halving of the surface potential obtained by charging.

Thus, the invention described herein makes possible the advantages of providing an image forming apparatus which prevents generation of residual carriers in an organic photosensitive film and thus significantly improves the image quality.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings. The present invention is not limited to the following examples.

According to the present invention, an image forming apparatus includes a rotatable photosensitive member including a conductive base and an organic photosensitive film located on a surface of the base and containing two charge generation materials which have different light absorbing characteristics from each other and different wavelengths showing a maximum light absorbance from each other. The image forming apparatus further includes a charge removing member for generating light having a wavelength in the range between wavelengths corresponding to half of the maximum light absorbance of at least one of the two charge generation materials contained in the organic photosensitive film. A surface potential of the organic photosensitive film is uniformized by light radiation from the charge removing member. Such radiated light is properly absorbed by the organic photosensitive film and thus is prevented from reaching a bottom part thereof. Accordingly, generation of carriers caused by the light from the charge removing member is prevented.

For the above reason, the organic photosensitive film is more easily charged, and thus the image quality is improved. Furthermore, wearing of the organic photosensitive film by light is prevented.

Since the light generated by the charge removing member is single-color light, heat generation by the light is restricted. Accordingly, the inner temperature, especially, the surface temperature of the organic photosensitive film can be restricted. Thus, characteristics of the organic photosensitive film are stabilized, and the aging characteristic against repeated use of the image forming apparatus is also stabilized.

Figure 1:
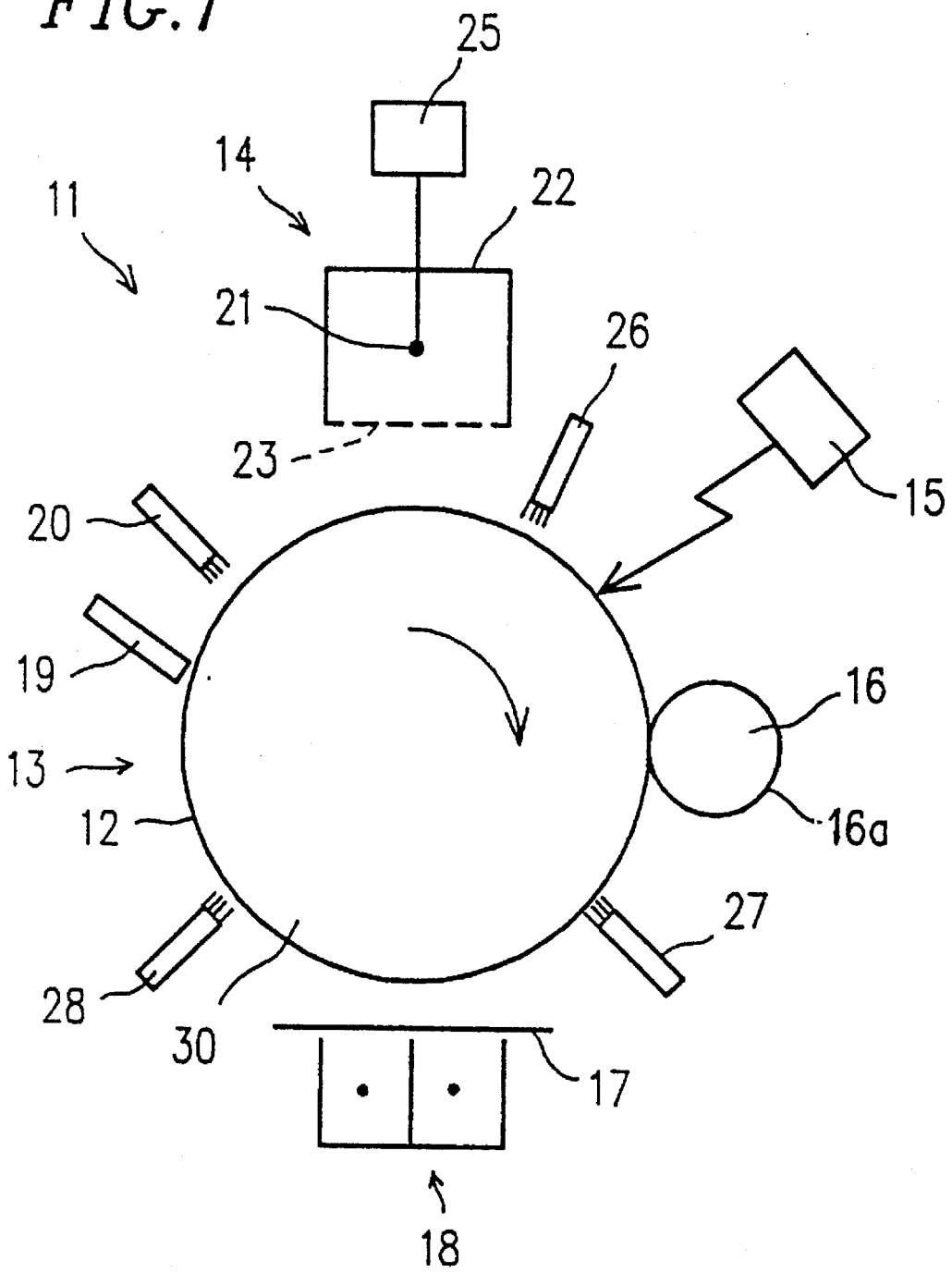
FIG. 1 is a schematic view of an image forming apparatus in an example according to the present invention.

Referring to FIG. 1, an image forming apparatus 11 in one example according to the present invention will be described. FIG. 1 is a schematic view of the image forming apparatus 11. As is shown in FIG. 1, the image forming apparatus 11 includes a rotatable photosensitive drum 13 acting as a photosensitive member which includes a drum substrate 30 formed of metal, for example, aluminum and a single-layer organic photosensitive film 12 (hereinafter, referred to simply as a "photosensitive film") located on a surface of the drum substrate 30. The photosensitive drum 13 is surrounded by a main charger 14 for uniformly supplying the photosensitive film 12 with a prescribed level of charge, an optical device 15 for generating light for exposing the photosensitive film 12 to form an electrostatic latent image on the photosensitive film 12, a developing device 16 for developing the electrostatic latent image on the photosensitive film 12 into a toner image, a transfer device 18 for transferring the toner image on the photosensitive film 12 onto, for example, a recording paper sheet 17, a cleaning device 19 for removing the residual toner on the photosensitive film 12 after the transference, and a charge removing device 20 acting as a charge removing member for removing the residual charge on the photosensitive film 12 to uniformize the surface potential of the photosensitive film 12.

The photosensitive film 12 contains two charge generation materials. The charge removing member such as the charge removing device 20 includes a light source for generating light having a wavelength in the range between wavelengths corresponding to half of the maximum light absorbance of at least one of the charge generation materials.

First, the charge removing member which is one feature of the present invention will be described.

Charge removing member

One or more charge removing members may be provided in the image forming apparatus 11. The charge removing member is most preferably located upstream with respect to the main charger 14 in a rotation direction of the photosensitive drum 13 as the charge removing device 20. The charge removing member uniformizes the surface potential of the photosensitive film 12 before the photosensitive film 12 is charged.

The charge removing member includes a removing lamp as a light source. Various types of light sources of visible light may be used. For example, a halogen lamp, a fluorescent lamp, a cold CRT, a neon lamp for emitting light of red, green or other colors, or a light source of single color light such as an LED (light emitting diode) for emitting light of red, yellow, green or other colors may be used.

For the charge removing member, a light source which generates light having a wavelength in the range between wavelengths corresponding to half of the maximum light absorbance of at least one of the charge generation materials contained in the photosensitive film 12 is selected. The wavelength of the light generated by the charge removing member should be determined by the light absorbance characteristic of the photosensitive film 12. However, the light absorbance characteristic of the photosensitive film 12 generally depends on the charge generation materials contained therein. Accordingly, the wavelength of the light generated by the charge removing member can be determined by the light absorbance characteristic of the charge generation materials.

Figure 2:
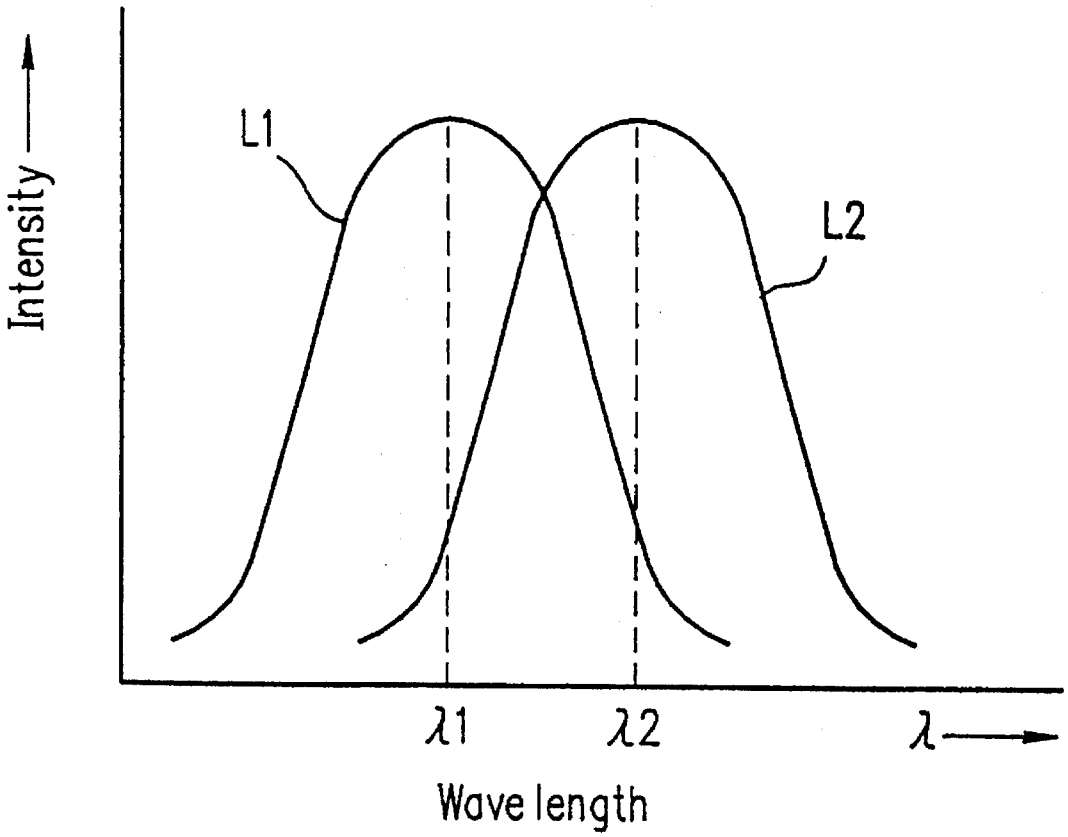
FIG. 2 is a graph illustrating the light absorbance characteristic of a photosensitive film of the image forming apparatus shown in FIG. 1.

Hereinafter, a method for selecting the charge removing member will be described. FIG. 2 is a graph illustrating the light absorbance characteristics L1 and L2 of the two charge generation materials contained in the photosensitive film 12. In the case where the wavelengths λ1 and λ2 corresponding to the maximum light absorbances of the light absorbance characteristics represented by L1 and L2 are sufficiently close to each other, the charge removing member can be a single light source. In the case where the charge removing member is a single light source, the wavelength of the light generated by the charge removing member is preferably in the range between wavelengths corresponding to half of the maximum light absorbance of at least one of the two charge generation materials. More preferably, the peak wavelength of the light generated by the charge removing member is in the range between wavelengths corresponding to half of the maximum light absorbance of either of the two charge generation materials. Most preferably, the peak wavelength of the light generated by the charge removing member is in the range which is common to the range between wavelengths corresponding to half of the maximum light absorbance of one of the two charge generation materials and such a range of the other charge generation material. Light having such a peak wavelength is preferable in terms of charge removing efficiency and stability against repeated use. "Peak wavelength" is the wavelength corresponding to the maximum intensity in a wavelength spectrum of the light radiated by the charge removing member. The charge removing member preferably generates single-color light. In the case where one charge removing member includes a plurality of light sources, such light sources need to be selected in consideration of the above-described points.

In the case where the wavelengths λ1 and λ2, corresponding to the maximum light absorbances of the light absorbance characteristics L1 and L2, are far from each other, one charge removing member includes a plurality of light sources. Preferably, such a plurality of light sources generate single-color light of different colors, each having a wavelength in the range between wavelengths corresponding to half of the maximum light absorbance of the respective charge generation material. More preferably, the peak wavelength of single-color light generated by each light source is in the range between wavelengths corresponding to half of the maximum light absorbance of the respective charge generation material.

The light generated by the charge removing member has a wavelength spectrum of a certain range. Among components of the light generated by the charge removing member, a component having a wavelength which is in the range between wavelengths corresponding to half of the intensity at the peak wavelength is preferably radiated in consideration of the intensity of light and the like.

As is described above, one or more charge removing members may be provided in the image forming apparatus 11. Most preferably, the charge removing member is located upstream with respect to the main charger 14 in the rotation direction of the photosensitive drum 13 as the charge removing member 20. Another charge removing member may be a blank lamp 26 located between the main charger 14 and the developing device 16 for radiating light to a part of the photosensitive film 12 to perform masking, trimming, or other processing. Still another charge removing member may be a pre-transference removing device 27 located between the developing device 16 and the transfer device 18 for removing the charge on the photosensitive film 12 before transference. Still another charge removing member may be a pre-cleaning removing device 28 located between the transfer device 18 and the cleaning device 19 for removing the charge on the photosensitive film 12 before cleaning is performed by the cleaning device 19.

The charge removing members 20, 26, 27 and 28 radiate single-color light or light from two single-color light sources to the photosensitive film 12. Since such radiated light is excellently absorbed into the photosensitive film 12 and thus is prevented from reaching a bottom part of the photosensitive film 12, generation of carriers at the bottom part of the photosensitive film 12 by the light radiated by any of the charge removing members is avoided. Accordingly, the photosensitive film 12 is more easily charged, thus significantly enhancing the image quality. Furthermore, wearing of the photosensitive film 12 caused by the light is restricted. Since the charge removing members generate single-color light, heat generation by the light is restricted, thus restricting an increase in the inner temperature of the image forming apparatus 11.

Especially, an increase in the surface temperature of the photosensitive film 12 is restricted. Due to such restriction, the characteristics of the photosensitive film 12 are stabilized, and the aging characteristic of the image forming apparatus 11 after repeated use is stabilized.

Before charging the photosensitive film 12, the charge on the photosensitive film 12 is removed to reduce the surface potential of the photosensitive film 12 to, for example, 100 V or less. In order to realize such a level of the surface potential, the charge removing member may preferably generate light of about 5 lux·sec or more, preferably about 10 lux·sec or more, depending on the type of the photosensitive film 12. The illuminance of the light used for charge removal by each charge removing member is preferably about 200 lux·sec or less. If any charge removing member generates light of more than about 200 lux·sec., the image quality possibly deteriorates due to wearing of the photosensitive film 12.

In the case where one charge removing member is located upstream with respect to the main charger 14 in the rotation direction of the photosensitive drum 13 as the charge removing device 20, the intensity of charge removing light is selected so that the residual potential left by charge removal after the first rotation of the photosensitive drum 13 is about 10% or less of the surface potential obtained by charging and that the increase ratio of the residual potential obtained by charge removal after the final rotation of the photosensitive drum 13 is about 30% or less. The increase ratio of the residual potential is represented with respect to the residual potential left by charge removal after the first rotation. If the residual potential after the first rotation is about 10% or more of the surface potential obtained by charging, the surface potential obtained after the second or later rotations is reduced, which is undesirable. If the increase ratio after the final rotation is more than about 30%, the surface potential for a single recording medium is reduced, thereby causing non-uniformity in the image density. The intensity of the light generated by the charge removing device 20 is preferably at least 20 times the intensity of light required for reducing the surface potential to half. If such intensity is less than 20 times, the intensity of the charge removing light is not sufficient to reduce the residual charge.

Main Charger

Returning to FIG. 1, the main charger 14 includes a discharge wire 21 for performing corona discharge, a shielding case 22 surrounding the discharge wire 21 and having an opening opposed to the photosensitive drum 13, and a metal grid 23 located at the opening of the shielding case 22. The discharge wire 21 is connected to a power source 25 for supplying the discharge wire 21 with a necessary amount of current for the corona discharge. The shielding case 22 is grounded.

As the main charger 14, a scorotron charger is preferably used. In the case when a scorotron charger is used, the surface potential of the photosensitive drum 13 at a charging position reaches and is maintained at a prescribed maximum limit for the following reason.

A current Icc from the power source 25 flowing to the discharge wire 21 is branched into a discharge current Isc flowing to the shielding case 22, a discharge current Igc flowing to the grid 23, and a discharge current Ipc flowing to the photosensitive drum 13. In order to allow the discharge current from the discharge wire 21 to reach the surface of the photosensitive film 12 through the grid 23, the surface potential of photosensitive film 12 needs to be lower than the potential of the grid 23.

When the discharge current Ipc is supplied to the charging position of the photosensitive film 12 by discharge performed by the discharge wire 21, the surface potential of the photosensitive film 12 gradually rises. When the surface potential of the photosensitive film 12 becomes substantially equal to the potential of the grid 23, no discharge occurs thereafter between the grid 23 and the photosensitive film 12. Accordingly, the current Icc supplied to the discharge wire 21 is branched only to the discharge currents Isc and Igc. Accordingly, the surface potential of the photosensitive film 12 is generally determined by the potential of the grid 23 and is maintained in the vicinity of the potential of the grid 23.

Generally, it is preferable to charge the photosensitive film 12 by the main charger 14 so that the surface potential of the photosensitive film 12 is in the range between about 500 V and about 1,000 V, preferably in the range between about 700 V and about 850 V and that $\Delta SP/\Delta Icc \leqq 0.5$ V/μA. In order to perform such charging, it is preferable to apply a high voltage of about 4 to about 7 kV to the discharge wire 21 of the main charger 14 when performing corona discharge.

Optical device, developing device and transfer device

In the image forming apparatus 11 according to the present invention, the optical device 15 is used for exposing the electrostatic latent image to form a toner image. An optical device 15 includes an optical system including a lens, a reflecting mirror and the like, and a laser oscillator, or the like may be used.

The developing device 16 is provided with a developing roller **16*a* for supplying the surface of the photosensitive film 12** with a mono-component or a two-component toner which is charged.

As the transfer device 18, a corona charger similar to the one used as the main charger 14 or a contact charger may be used.

Organic photosensitive film

In the image forming apparatus 11 according to the present invention, the photosensitive film 12 can be of various types. In a preferable embodiment, the photosensitive film 12 is a single-layer organic photosensitive film of a type to be positively charged, which is formed by diffusing a charge generation material in a charge carrying medium.

Any charge generation material which is generally used by those of ordinary skill in the art may be used. An organic photoconductive pigment is especially preferable. Preferably, the charge generation material is a photoconductive organic pigment such as a phthalocyanine-type pigment, a perylene-type pigment, a quinacridone-type pigment, a pyranetron-type pigment, a bisazo-type pigment, or a trisazo-type pigment. In the image forming apparatus 11, two or more such photoconductive pigments are used in combination.

The charge carrier medium may be formed by diffusing a charge carrying material in a bonding resin.

As the charge carrying material, a hole carrying material or an electron carrying material which is generally used by those of ordinary skill in the art may be used.

As the hole carrying material, a phenylenediamine-type compound, for example, N,N,N',N'-tetrakis(3-methylphenyl)-m-phenylenediamine, poly-N-vinylcarbazole, phenanthrene, N-ethylcarbazole, 2,5-diphenyl-1,3,4-oxyadiazole, 2,5-bis(4-diethylaminophenyl)-1,3,4-oxadiazole, bis-diethylaminophenyl-1,3,6-oxadiazole, 4,4'-bis(diethylamino)-2,2'-dimethyltriphenylmethane, 2,4,5-triaminophenylimidazole, 2,5-bis(4-diethylaminophenyl)- 1,3,4-triazole, 1-phenyl-3-(4-diethylaminostyril)- 5-(4-diethylaminophenyl)-2-pyrazoline, or p-diethylaminobenzaldehyde(diphenylhydrazone) may be used. Such compounds may be used independently or in combination of two or more.

As the electron carrying material, phenoquinone, for example, 3,5,3',5'-tetraphenyldiphenoquinone, 2-nitro-9-fluorenone, 2,7-dinitro-9-fluorenone, 2,4,7-trinitro-9-fluorenone, 2,4,5,7-tetranitro-9-fluorenone, 2-nitrobenzothiophene, 2,4,8-trinitrothioxantone, dinitroanthracene, dinitroacridine, or dinitroantoquinone may be used. Such materials may be used independently or in combination of two or more.

As the bonding resin, for example, a styrene-type polymer, a styrene-butadiene copolymer, a styrene-acrylonitrile copolymer, a styrene-maleic acid copolymer, an acryl-type polymer, a styrene-acryl-type copolymer, a styrene-vinyl acetate copolymer, a poly(vinyl chloride), a vinyl chloride-vinyl acetate copolymer, polyester, an alkyd resin, polyamide, polyurethane, an epoxy resin, polycarbonate, polyallylate, polysulfone, a diallylphthalate resin, a silicone resin, a ketone resin, a polyvinylbutylale resin, a polyether resin, a phenol resin; a photocurable resin such as epoxy acrylate or urethane acrylate; or other copolymers may be used. A photoconductive polymer such as poly-N-vinylcarbazole may also be used.

The amount of the charge generation material contained in the photosensitive film 12 is preferably about 0.1 to about 50 parts, more preferably about 0.5 to about 30 parts with respect to 100 parts of the bonding resin. The amount of the charge carrying material contained in the photosensitive film 12 is preferably about 20 to about 500 parts, more preferably about 30 to about 200 parts with respect to 100 parts of the bonding resin. The photosensitive film 12 preferably has a thickness of about 10 to about 40 μm, more preferably about 22 to about 32 μm in order to obtain a sufficiently high surface potential, a high durability against repeated image forming, and high sensitivity.

The drum substrate 30 may be formed of any conductive material, preferably conductive metal. In general, the drum substrate 30 is formed of a plain aluminum tube or an aluminum tube with an alumetized surface. The drum substrate 30 may also be formed of a conductive resin, a conductive film or the like. The substrate may be provided in the form of a sheet, a belt, a drum or the like.

The photosensitive film 12 is formed in the following manner.

The bonding resin is dissolved in a solvent, and the charge generation material and, if necessary, the charge carrying material are diffused in the dissolved bonding resin to prepare a composition. The composition is applied to the surface of the drum substrate 30 and dried. As the solvent, for example, an amide-type solvent such as N,N-dimethylformamide or N-N-dimethylacetoamide; a cyclic ether such as tetrahydrofuran or dioxan; dimethylsulfoxide; an aromatic solvent such as benzene, toluene, or xylene; ketone such as methylethylketone; N-methyl-2-pyrrolidone; or phenol such as phenol or cresol may be used.

The present invention has a remarkable advantage when a single-layer organic photosensitive body of a type to be positively charged is used. Such a type of photosensitive body is advantageous in generating very little ozone when charged. In the case that such a type of photosensitive body is used, a perylene-type pigment, an azo-type pigment or a combination of the two is preferably used as the charge generation material. As the charge carrying material, a diphenoquinone derivative such as 2,6-dimethyl-2',6-ditert-butyl-diphenoquinone, a diamine-type compound such as 3,3'-dimethyl-N,N,N',N'-tetrakis- 4-methylphenyl(1,1'-biphenyl)-4,4'-diamine, a fluorene-type compound, or a hydrazone-type compound is preferably used.

In this example, an electrostatic copier is used as the image forming apparatus. Needless to say, the present invention is applicable to any image forming apparatus for forming an image using an electrophotographic technology.

EXAMPLE

Preparation of the photosensitive film

Materials having the following compositions were mixed by a ball mill and diffused for 2 hours to prepare a photosensitive liquid used for a single-layer organic photosensitive film 12.

| | |
|---|---|
| Bisazo pigment represented by formula I (maximum light absorbance at 550 nm; range between wavelengths corresponding to half of the maximum light absorbance: 490 to 585 nm) | 5 parts |
| Perylene pigment represented by formula II (maximum light absorbance at 550 nm; range between wavelengths corresponding to half of the maximum light absorbance: 450 to 570 nm) | 5 parts |
| 3,3'-dimethyl-N,N,N',N'-tetrakis-4-methylphenyl(1,1'-biphenyl)-4,4'-diamine (hole carrying material) | 100 parts |
| 3,3'-dimethyl-5,5'-ditert-butyl-4,4'-diphenoquinone | 50 parts |
| Polycarbonate resin | 150 parts |
| Dichloromethane | 800 parts |

-continued

Formula I

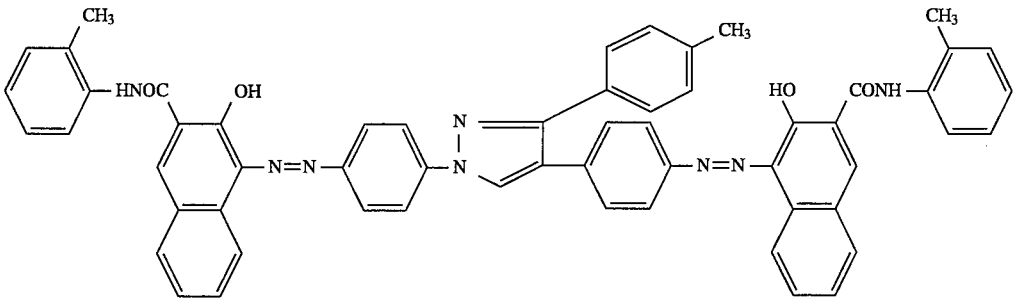

Formula II

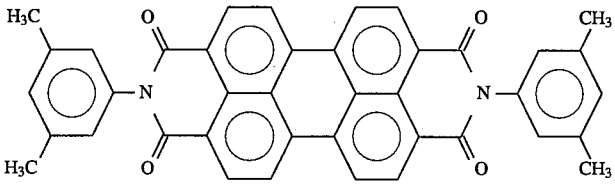

An aluminum cylinder having an outer diameter of 30 mm was immersed in the photosensitive liquid and dried at a temperature of 110° C. for 30 minutes, thereby forming an organic photosensitive film having a thickness of 30 μm on an outer surface of the aluminum cylinder. In this manner, the single-layer electrophotographic photosensitive drum 13 of a type to be positively charged was obtained.

Evaluation of the image forming apparatus

Figure 3:
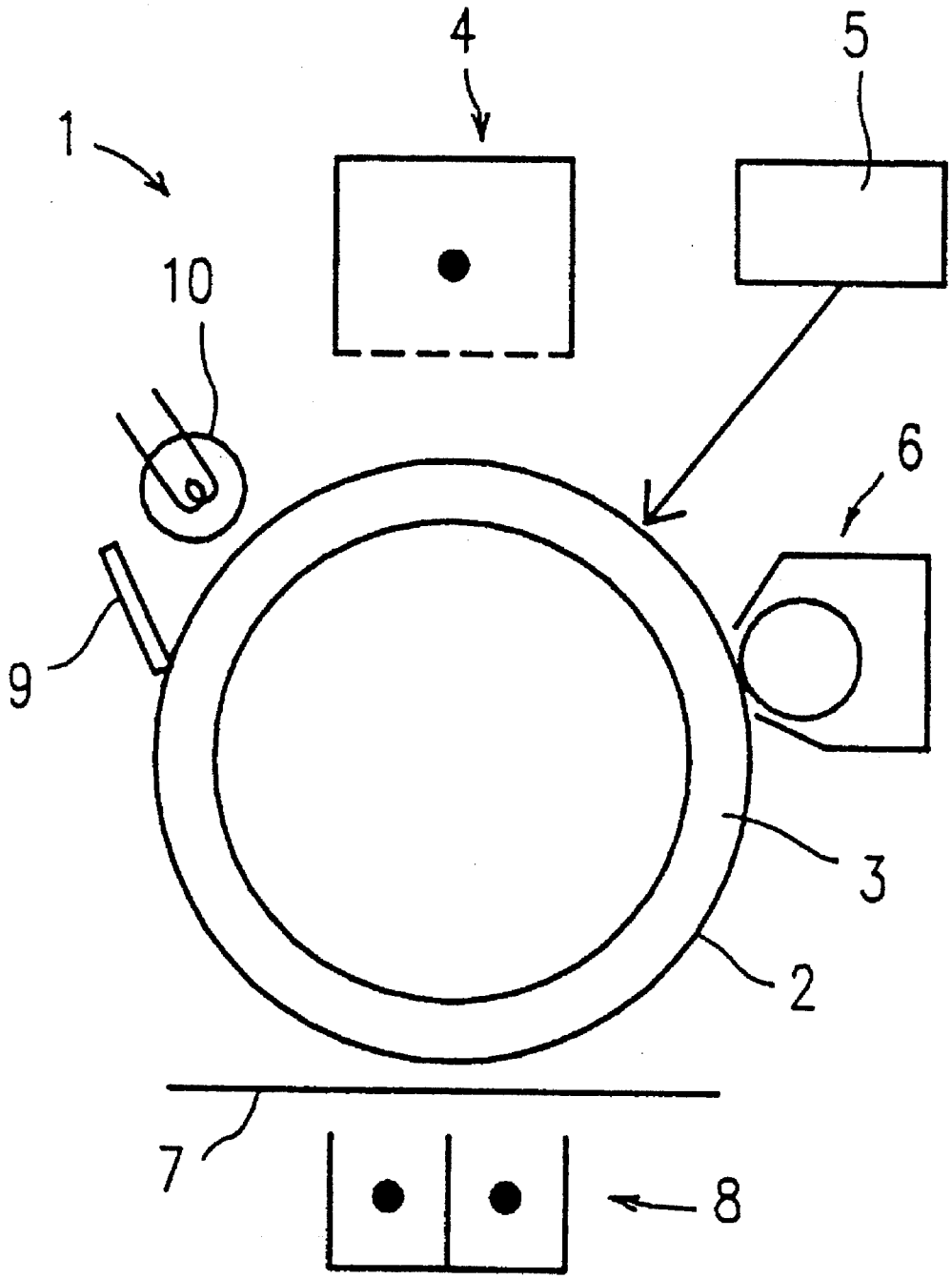
FIG. 3 PRIOR ART
FIG. 3 is a schematic view of a conventional image forming apparatus.
Figure 4:
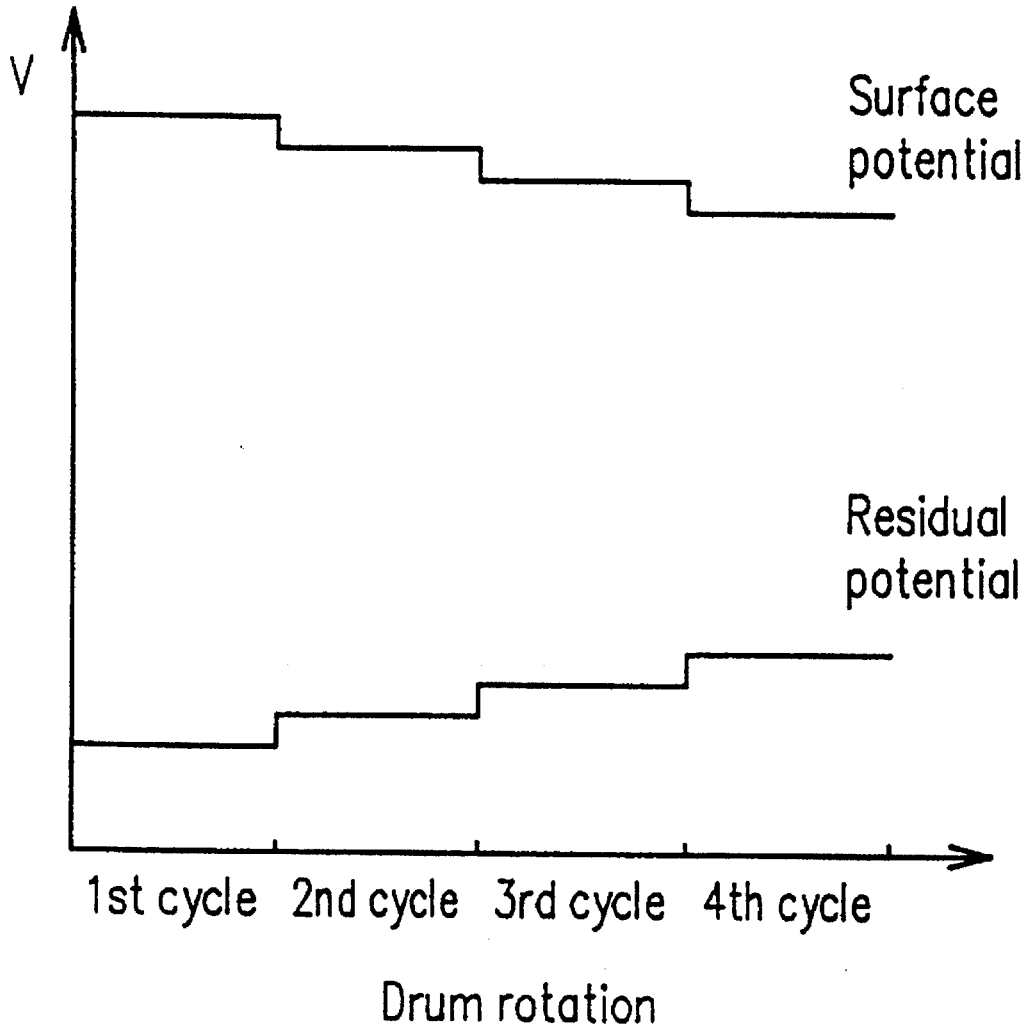
FIG. 4 is a graph illustrating the surface potential and the residual potential in accordance with repeated rotation of a photosensitive drum of the conventional image forming apparatus.

For the following experiments, an apparatus improved from DC-2556 produced by Mira Industrial Co., Ltd. equipped with the image forming apparatus 11 shown in FIG. 3 was used. The improved apparatus was obtained by replacing the developing section of DC-2556 with a surface potential sensor. An aging test was performed using the following charge removing members, namely, charge removing lamps. In the aging test, each section of the image forming apparatus 11 was operated without performing developing or using any recording medium. The circumferential speed of the photosensitive drum 13 was set at 300 mm/sec., and the initial surface potential of an area corresponding to the developing section was 800 V. The intensity of light generated by the charge removing lamp was selected so that the surface potential after charge removal would be 50 V.

Example 1

A single charge removing lamp for generating light having a peak wavelength in the range which is common to the range between wavelengths corresponding to half of the maximum light absorbance of one of the two charge generation materials and such a range of the other charge generation material was used. Specifically, a green LED for emitting light having a wavelength of 565 nm (the range between wavelengths corresponding to the intensity at the peak wavelength: 555 to 580 nm) was used.

Example 2

A charge removing lamp for generating light having a peak wavelength exceeding the range between wavelengths corresponding to half of the maximum light absorbance of one of the two charge generation materials and a charge removing lamp for emitting light having a peak wavelength within the range between wavelengths corresponding to half of the maximum light absorbance of the other charge generation materials were used in combination. Specifically, a yellow LED having a wavelength of 580 nm (the range between wavelengths corresponding to the intensity at the peak wavelength: 520 to 600 nm) was used as the former, and a green LED for emitting light having a wavelength of 565 nm (the range between wavelengths corresponding to the intensity at the peak wavelength: 555 to 580 nm) was used as the latter.

Example 3

A single charge removing lamp for generating light having a peak wavelength exceeding both the ranges between wavelengths corresponding to half of the maximum light absorbance of the two charge generation materials.

Specifically, a yellow LED for emitting light having a wavelength of 580 nm (the range between wavelengths corresponding to the intensity at the peak wavelength: 520 to 600 nm) was used.

Comparative example

In the comparative example, the range between wavelengths corresponding to half of the intensity at the peak wavelength of the light generated by a single charge removing lamp does not overlap the range between wavelengths corresponding to half of the maximum light absorbance of either of the two charge generation materials. Specifically, a red LED for emitting light having a wavelength of 660 nm (the range between wavelengths corresponding to the intensity at the peak wavelength: 628 to 675 nm) was used.

Results

The dark potential (the surface potential of the photosensitive film 12 obtained when the photosensitive film 12 is not exposed to light; SP0) and the bright potential (the surface potential obtained by exposing the photosensitive film 12 at the prescribed illuminance of 3.5 lux·sec; V3.5) which were obtained after the first, 1,000th, and 3,000th rotation of the photosensitive drum 13 were measured and are shown in Table 1. The bright potential after the 1,000th and 3,000th rotation were obtained by the same intensity of light as the bright potential after the first rotation.

TABLE 1

| | 1st | | 1,000th | | 3,000th | |
|---|---|---|---|---|---|---|
| | SPO | V3.5 | SPO | V3.5 | SPO | V3.5 |
| Ex 1 | 800 | 250 | 800 | 245 | 795 | 250 |
| Ex 2 | 800 | 250 | 790 | 250 | 785 | 255 |
| Ex 3 | 800 | 250 | 785 | 255 | 780 | 255 |
| Comparative example | 800 | 250 | 750 | 230 | 700 | 200 |

It is appreciated from Table 1 that the aging characteristic against repeated use is most stable in Example 1 using a charge removing lamp for emitting light having a peak wavelength in the range which is common to the range between wavelengths corresponding to half of the maximum light absorbance of one of the two charge generation materials (a perylene pigment and a bisazo pigment) and such a range of the other charge generation material.

In Example 2, due to the charge removing lamp for generating light having a peak wavelength in the range between wavelengths corresponding to half of the maximum light absorbance of the one of the two charge generation materials, the aging characteristic is stable against repeated use. Compared with Example 1, however, the dark potential is slightly lower and the bright potential is slightly higher.

As is appreciated from the results in Example 3, a charge removing effect can still be achieved if the range between wavelengths corresponding to half of the intensity at the peak wavelength of the light generated by the single light source overlaps the range between wavelengths corresponding to half of the maximum light absorbance of one of the two charge generation materials even though the peak wavelength of such light exceeds the above-described two ranges.

As is appreciated from the results in the comparative example, in the case where the range between wavelengths corresponding to half of the intensity at the peak wavelength of the light generated by the single charge removing lamp does not overlap the range between wavelengths corresponding to half of the maximum light absorbance of either of the two charge generation materials, the aging characteristic is not sufficiently stable.

As is understood from the above description, it is effective to select a charge removing lamp for generating light having a wavelength in the range between wavelengths corresponding to half of at least one of the two charge generation materials.

According to the present invention, the charge removing member radiates light having a prescribed wavelength toward an organic photosensitive film of a photosensitive member. The light thus radiated is excellently absorbed by the photosensitive film and prevented from reaching the deep part of the photosensitive film. Thus, generation of carriers in the deep part of the photosensitive film by the light generated by the charge removing member is prevented. Therefore, the amount of residual carriers which exist on the photosensitive film when the photosensitive film is charged by the main charger is reduced, and thus the photosensitive film is more easily charged. As a result, the image quality is significantly improved. Furthermore, wearing of the photosensitive film by light is alleviated. Since the light generated by the charge removing member is preferably a single-color light, heat generation by the light is restricted. Accordingly, the inner temperature of the image forming apparatus, especially, the surface potential of the photosensitive film is restricted. Due to such restriction of heat, the characteristics of the photosensitive film are stabilized. The aging characteristic against repeated use of the image forming apparatus is also stabilized.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An image forming apparatus, comprising:

a rotatable photosensitive member including a conductive base and an organic photosensitive film located on a surface of the base and containing two charge generation materials which have different light absorbing characteristics from each other and different wavelengths showing a maximum light absorbance from each other;

charging means for charging the organic photosensitive film, the charging means being located in the vicinity of the photosensitive member;

exposing means for radiating light toward the organic photosensitive film charged by the charging means;

developing means located downstream with respect to the exposing means in a rotation direction of the photosensitive member; and charge removing means including a light source for radiating light toward the organic photosensitive film to uniformize the potential of a surface of the organic photosensitive film, the light having a wavelength in the range between wavelengths corresponding to half of a maximum light absorption of at least one of the two charge generation materials.

2. An image forming apparatus according to claim 1, further comprising transfer means and cleaning means, wherein the transfer means is located downstream with respect to the exposing means in the rotation direction of the photosensitive member, the cleaning means is located downstream with respect to the transfer means in the rotation direction of the photosensitive member, and the charge removing means is located in at least one position selected from the group consisting of:

between the cleaning means and the charging means, between the charging means and the developing means, between the developing means and the transfer means, and between the transfer means and the cleaning means.

3. An image forming apparatus according to claim 1, wherein the charge removing means is located upstream with respect to the charging means in the rotation direction of the photosensitive member.

4. An image forming apparatus according to claim 1, wherein the charge removing means includes a single light source which generates light having a wavelength in the range which is common to the range between wavelengths corresponding to half of the maximum light absorbance of one of the two charge generation materials and the range between wavelengths corresponding to half of the maximum light absorbance of the other charge generation material.

5. An image forming apparatus according to claim 1, wherein the charge removing means includes two light sources each generating light of a single color having a wavelength in the range between wavelengths corresponding to half of the maximum absorption of the respective charge generation material.

6. An image forming apparatus according to claim 1, wherein the charge removing means generates light having an intensity which is at least 20 times the intensity for required halving the surface potential obtained by charging.

7. An image forming apparatus, comprising:

a rotatable photosensitive member including a conductive base and an organic photosensitive film located on a surface of the base and containing two charge generation materials which have different light absorbing characteristics from each other and different wavelengths showing a maximum light absorbance from each other;

charging means for charging the organic photosensitive film, the charging means being located in the vicinity of the photosensitive member;

exposing means for radiating light toward the organic photosensitive film charged by the charging means;

developing means located downstream with respect to the exposing means in a rotation direction of the photosensitive member; and charge removing means including a light source for radiating light toward the organic photosensitive film to uniformize the potential of a surface of the organic photosensitive film, the light having a wavelength in the range between wavelengths corresponding to half of a maximum light absorption of at least one of the two charge generation materials;

wherein the photosensitive member has such a size that repeated rotation thereof beginning with a first rotation and ending with a final rotation allows transfer of an image on the organic photosensitive film onto a single recording medium, and the charge removing means radiates light having such an intensity that a residual potential on a surface of the photosensitive member left by charge removal after the first rotation of the photosensitive member is no greater than 10% of the surface potential thereof obtained by charging and that an increase ratio of the residual potential after the final rotation of the photosensitive member with respect to the residual potential after the first rotation involved in the transfer of an image is no greater than 30% with respect to after the first rotation.

8. An image forming apparatus according to claim 7, further comprising transfer means and cleaning means, wherein the transfer means is located downstream with respect to the exposing means in the rotation direction of the photosensitive member, the cleaning means is located downstream with respect to the transfer means in the rotation direction of the photosensitive member, and the charge removing means is located in at least one position selected from the group consisting of:

between the cleaning means and the charging means, between the charging means and the developing means, between the developing means and the transfer means, and between the transfer means and the cleaning means.

9. An image forming apparatus according to claim 7, wherein the charge removing means is located upstream with respect to the charging means in the rotation direction of the photosensitive member.

10. An image forming apparatus according to claim 7, wherein the charge removing means includes a single light source which generates light having a wavelength in the range which is common to the range between wavelengths corresponding to half of the maximum light absorbance of one of the two charge generation materials and the range between wavelengths corresponding to half of the maximum light absorbance of the other charge generation material.

11. An image forming apparatus according to claim 7, wherein the charge removing means includes two light sources each generating light of a single color having a wavelength in the range between wavelengths corresponding to half of the maximum absorption of the respective charge generation material.

12. An image forming apparatus according to claim 7, wherein the charge removing means generates light having an intensity which is at least 20 times the intensity required for halving the surface potential obtained by charging.

* * * * *